United States Patent [19]

Bennett et al.

[11] 4,313,476

[45] Feb. 2, 1982

[54] DUAL LANE FILLING MACHINE

[75] Inventors: Richard N. Bennett, Arbutus; Lawrence W. Buckley, Baltimore, both of Md.

[73] Assignee: National Instrument Company, Inc., Baltimore, Md.

[21] Appl. No.: 88,340

[22] Filed: Oct. 26, 1979

[51] Int. Cl.[3] ..... B65B 43/54

[52] U.S. Cl. ..... 141/59; 141/119; 141/169; 141/181; 141/183

[58] Field of Search ..... 141/163, 168, 169, 177, 141/180, 181, 183, 186, 188–191, 59, 119

[56] References Cited

U.S. PATENT DOCUMENTS

| | | | |
|---|---|---|---|
| 2,989,993 | 6/1961 | Osmond et al. | 141/169 X |
| 4,055,202 | 10/1977 | Greene | 141/59 |
| 4,073,322 | 2/1978 | Bennett | 141/169 |

*Primary Examiner*—Frederick R. Schmidt
*Attorney, Agent, or Firm*—Craig and Antonelli

[57] ABSTRACT

A filling machine for filling containers with a fluid product by the use of filling nozzles with two substantially parallel filling channels which are formed in part by two separate conveyors, with a vacuum filling mechanism connected with the filling nozzles, with a support for the filling nozzles, with a mechanism for lowering and raising the nozzle support and therewith the filling nozzles into and out of containers held stationary under the filling nozzles, with an indexing mechanism for determining the correct number of containers to be filled at the same time in a respective channel during a given filling operation while held stationary in their filling positions, with a reciprocating mechanism for the nozzle support to alternately place the filling nozzles over the containers to be filled in one channel and after completion of the filling operation to move the nozzle support over the other channel to fill the containers which have been brought into filling position in the meantime in the other channel means, and with a control system for operating the filling machine through at least one control cycle.

42 Claims, 5 Drawing Figures

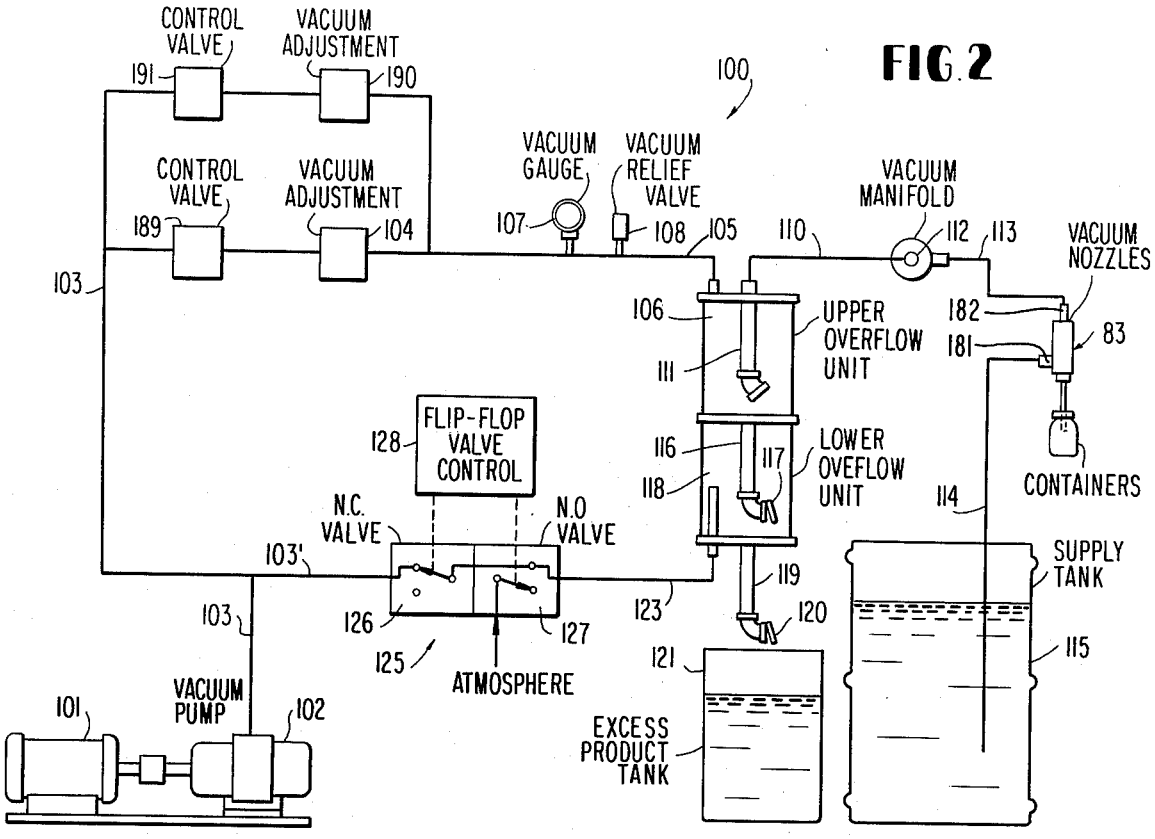
FIG. 2
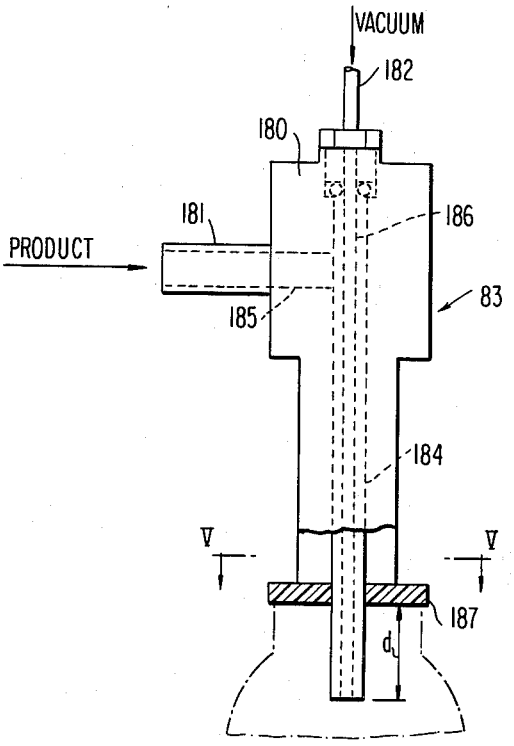
FIG. 4
FIG. 5
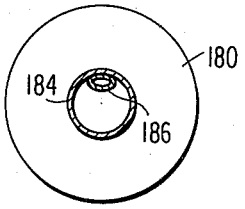

DUAL LANE FILLING MACHINE

The present invention relates to a filling machine, and more particularly, to a high-speed filling machine for filling containers with a quick-drying product.

Various types of filling machines are known in the prior art. For example, the U.S. Pat. No. 3,237,661 discloses a filling machine which has proved very successful with many different products. However, this type of filling machine poses problems if used with products which dry quickly upon contact with air, such as nail polish, and which would thus require frequent cleaning of the nozzles and possibly also of other parts of the system when changing color or when shutting down the machine for other reasons.

So-called vacuum filling machines are also known in the prior art, in which the containers are sealed hermetically during the filling operation and a vacuum system is used to suck the product into the containers. Since the linear speed of a straight-line vacuum filler is limited by the conveyor speed that can reasonably be used, so-called rotary vacuum fillers have been used heretofore which permit an increase in the filling speed of the machine. However, in rotary vacuum filling machines, about thirty percent of the nozzles are always exposed to the atmosphere, which means that air is aspirated through the thirty percent of nozzles if the machine is stopped in any position. Consequently, even such rotary vacuum filling machines pose serious problems when intended to be used with quick-drying products.

A principal object of the present invention resides in a high-speed filling machine which permits the filling of containers with a quick-drying product and which eliminates by extremely simple means the aforementioned shortcomings and drawbacks encountered in the prior art.

The underlying problems are solved according to the present invention by a dual-lane straight-line filling machine which utilizes the basic concept of reciprocating the nozzle support structure between two filling lanes or channels as disclosed in the U.S. Pat. No. 4,073,322, but which in distinction from this last-mentioned prior patent, utilizes separate conveyors for two substantially parallel filling lanes or channels at the filling station that can be operated intermittently, i.e., started and stopped individually in proper timed sequence. This permits the use of a vacuum filling system, in which the top of the containers are sealed off hermetically by the nozzle structure during the filling operation and in which vacuum is used to suck-in the product since the stoppage of the conveyor renders less likely the breakage of the vacuum seal as might occur otherwise with a continuously operating conveyor. The intermittent operation is thus important with a vacuum filling system since a continuously operable conveyor would have to slip relative to the containers held stationary during the filling operation which always represents a danger to topple containers and/or to cause a breakage of the seal.

According to another feature of the present invention, the two filling lanes or channels merge into a feed-out lane or channel downstream of the filling stations, which is physically located intermediate the two substantially parallel filling channels and which includes a further conveyor whose linear speed can be adjusted to be greater than the linear speed of the separate conveyors of the two filling channels. The further conveyor for the feed-out channel also constitutes the conveyor for a feed-in channel that branches into the two parallel filling channels upstream of the filling stations.

According to still another feature of the present invention, a container diverter mechanism is located at the place where the feed-in channel branches out into the parallel filling channels, which positively directs the containers into one or the other of the parallel channels.

According to a further feature of the present invention, the filling machine includes a cam-operated control for stopping the machine in such a position that the filling nozzles remain sealingly in the containers which have just been filled. The cam shaft, which carries the cam for a nozzle inserter limit switch stopping the machine with the containers remaining hermetically sealed, additionally carries a cam for a single-cycle limit switch which permits single-cycle operation of the machine, if so desired. However, according to still a further feature of the present invention, all other controls are realized by limit switches which are responsive to physical movements of corresponding parts in a given direction. This permits a simple sequence control, in which an operating function is initiated during or near the end of movement of the respective part such as the nozzle support structure during its reciprocating and/or vertical motions.

A particularly simple vacuum system in accordance with the present invention utilizes a vacuum source connected with a vacuum manifold by way of an upper overflow unit, whereby each nozzle structure is connected with the vacuum manifold by way of its vacuum connection and with a supply reservoir or tank for the product to be filled by way of its product feed connection. The upper overflow unit is connected with a lower overflow unit by way of a discharge tube which extends from the bottom area of the upper overflow unit into the lower overflow unit and is provided with a vacuum-operated pivotal lid at the free lower end thereof. The lower overflow unit in turn is provided in its bottom area with a discharge tube which discharges into an excess product tank and is again provided at its free lower end with a vacuum-operated pivotal lid. The inside of the lower overflow unit is adapted to be selectively connected either with the atmosphere or with the vacuum source by way of a timer valve suitably controlled in predetermined timed sequence. Once the filling nozzles have been lowered into the containers to be filled and the seals carried by the nozzles have hermetically sealed the top of the containers, the product is sucked-out of the supply tank into the containers by the vacuum that will establish itself in the system by way of the upper overflow unit and the vacuum manifold, whereby the connection between the upper overflow unit and lower overflow unit is closed by the pivotal lid, as long as the lower overflow unit is under atmospheric pressure. The containers will then fill to the level of the extent of insertion of the tip of the nozzles into the containers, any excess product being drawn into the upper overflow unit, from where it will be discharged into the lower overflow unit and eventually into the excess product tank as will be described more fully hereinfter.

A particularly appropriate nozzle structure utilizes an outer tubular member of relatively larger cross-sectional area adapted to be connected with the line carrying the product to be filled. Within this outer tubular member, an inner tubular member of smaller cross-sectional area is adapted to be connected with the vacuum connection leading to the vacuum manifold. The inner tubular part is thereby preferably of approximately oval configuration adapted to the portion of the curvature of the internal surface of the outer tubular member to permit secure fastening thereto, for example, by silver soldering. The inner and outer tubular members terminate flush, i.e., extend the same length into the containers.

Accordingly, it is an object of the present invention to provide a high-speed filling machine which eliminates by simple means the aforementioned shortcomings and drawbacks encountered in the prior art.

Another object of the present invention resides in a high-speed filling machine which can be used also for filling products that dry quickly in contact with the air.

A further object of the present invention resides in a high-speed filling machine of the straight-line filling type which permits the use of a vacuum filling system without the need of frequent cleaning of the system when stopping the machine.

A still further object of the present invention resides in a straight-line vacuum filling machine which is easy to clean and to set up and is extremely simple to operate.

Still another object of the present invention resides in a high-speed filling machine of the type described above which can be shut down without the danger that the product will dry on the nozzles or other parts of the system.

Another object of the present invention resides in a high-speed filling machine of the type described above in which the nozzles remain in the liquid within the sealed containers when stopping the machine so that air which might cause a drying-up of the product on the nozzles, is prevented from entering the containers by the seal.

These and other objects, features, and advantages of the present invention will become more apparent from the following description when taken in conjunction with the accompanying drawing which shows, for purposes of illustration only, one embodiment in accordance with the present invention, and wherein:

FIG. 2 is a schematic view of the vacuum system used with the filling machine of the present invention;

FIG. 4 is an elevational view of a nozzle structure in accordance with the present invention; and FIG. 5 is a cross-sectional view through the nozzle structure taken along line V—V of FIG. 4.

Figure 1:
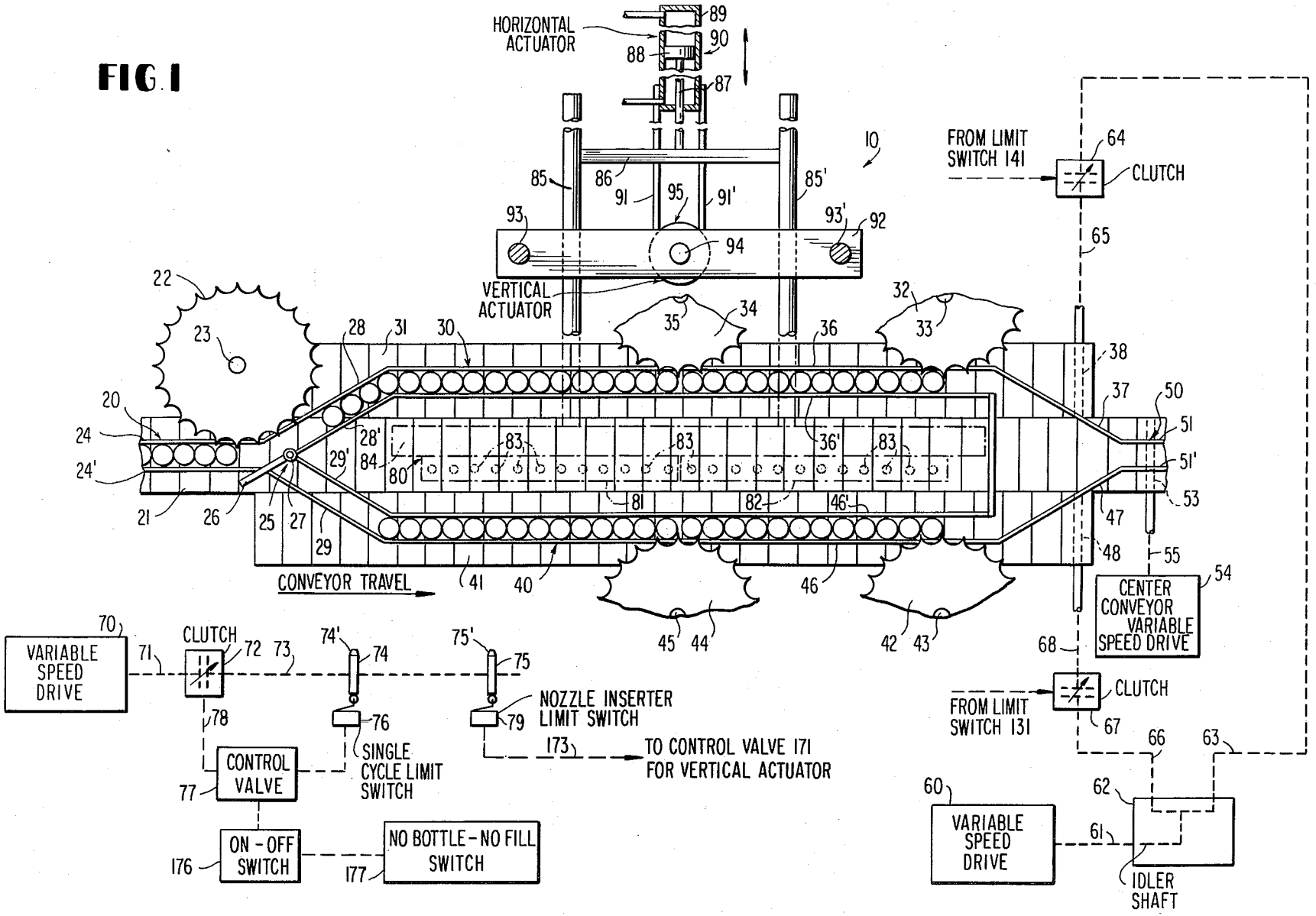
FIG. 1 is a schematic plan view of a dual-lane filling machine in accordance with the present invention.

Referring now to the drawing wherein like reference numerals are used throughout the various views to designate like parts, and more particularly to FIG. 1, the filling machine of the present invention includes a feed-in center lane or channel generally designated by reference numeral 20 which is defined at least in part by a continuously movable conveyor 21 and by suitable side wall members 24 and 24'. A star-wheel 22 freely rotatable on a pivot shaft 23 is provided as indexing mechanism which includes a number of pockets corresponding to the number of containers to be filled at the same time during a given filling operation. Since the filling machine of the present invention is intended to fill simultaneously twenty-four containers, the star wheel 22 has twenty-four pockets. The star wheel and its control are of the type more fully described in the U.S. Pat. No. 4,083,389 so that a further description thereof is dispensed with herein. A diverter mechanism generally designated by reference numeral 25 which includes a pivotal diverter arm 26 selectively pivoted by an actuating mechanism 27 of any known type diverts the containers selectively into the diverging feed-in channels formed by side wall members 28, 28' and 29, 29'.

The diverging feed-in channels 28, 28' and 29, 29' are connected with an inboard lane or filling channel generally designated by reference numeral 30 and with an outboard lane or filling channel generally designated by reference numeral 40. The two filling lanes or channels 30 and 40 thereby extend parallel within the area of the filling stations of the filling machine. The inboard lane or channel 30 is again defined at least in part by its own inboard conveyor 31 and suitable side wall members 36 and 36' while the outboard lane or channel 40 is defined at least in part by its own conveyor 41 and suitable side wall members 46 and 46'. Downstream of the filling station, convergent side wall members 37 and 47 are provided to lead the filled containers from the inboard and outboard channels or lanes 30 and 40 to a feed-out center lane generally designated by reference numeral 50 and defined again at least in part by the center conveyor 21 and by side wall members 51 and 51'. Suitable indexing means are also provided at each filling station in association with the inboard and outboard channels 30 and 40 which are preferably star-wheel indexing mechanisms. Moreover, since the filling machine of the present invention is intended to fill simultaneously twenty-four containers, and since the thickness of the glass or plastic material of each container has a tolerance of $\pm 1/32$ inches, two star wheels 32 and 34 and two star wheels 42 and 44 freely rotatable on pivot shafts 33 and 35 and pivot shafts 43 and 45, respectively, are utilized for the inboard and outboard channels 30 and 40, respectively, which may again be of the type as disclosed in U.S. Pat. No. 4,083,389.

The center conveyor 21 is driven by a drive shaft 53 with the use, for example, of sprocket gears (not shown) mounted thereon, the drive shaft 53 itself being driven from a variable speed motor drive 54 of conventional type by way of a mechanical driving connection 55. The drive system for the inboard and outboard conveyor belts 31 and 41 includes a variable speed drive 60, for example, consisting of an electric motor driving a zero-max variable speed drive, which in turn drives as idler shaft 61 operatively connected with the two drive shafts 38 and 48 carrying sprocket gears (not shown) by way of a suitable gearing unit 62 and mechanical connections which include, on the one hand, the mechanical connection 63 leading to the input of clutch 64 whose output is connected by way of connection 65 with the drive shaft 38, and on the other, the mechanical connection 66 leading to the input of clutch 67 whose output is connected with drive shaft 48 by way of the mechanical connection 68.

A variable speed drive 70 which again may consist of an electric motor that drives a zero-max variable speed drive to allow the operator to adjust the filling speed, is connected by way of shaft 71 with the input of a clutch 72, whose output is connected with the cam shaft 73 carrying thereon cams 74 and 75 having cam portions 74' and 75' operable to actuate respectively the single-cycle limit switch 76 and the nozzle inserter limit switch 79. The single-cycle limit switch 76 is thereby connected with a control valve 77 which controls the fluid medium for engagement of clutch 72 by way of line 78. The on-off switch 176 which in turn is connected with a conventional no-bottle, no-fill switch 177, is also operatively connected with the control valve 77 to prevent engagement of clutch 72 unless the on-off switch 176 is turned on and the no-fill switch 177 signals the presence of containers. The nozzle inserter limit switch 79 is operatively connected with the control valve 171 (FIG. 3) which controls the vertical actuator 95 as will be described more fully hereinafter.

The clutches 64, 67 and 72 may be of any conventional type but are preferably of the type which provide a positive stoppage of the output member when disengaged. For example, these clutches may be air-actuated spring clutches with an actuator paw engaging a stop collar to stop the respective conveyor belt. Since such devices are commercially available, a detailed description thereof is dispensed with herein.

The filling machine additionally includes a nozzle support structure 80 shown in FIG. 1 in dash and dotted lines that includes two nozzle holders 81 and 82 each adapted to hold twelve nozzles generally designated by reference numeral 83 and schematically indicated only in FIG. 1 by circles; the details of a nozzle 83 are illustrated more fully in FIGS. 4 and 5. The nozzle support structure 80 includes a unitary longitudinal support bar 84 carried by two transversely extending tubular support members 85 and 85' (FIG. 1) that are interconnected at the free ends thereof by a cross-connection 86 (FIGS. 1 and 3) which is fixed to a piston rod 87 carrying thereon a piston 88 adapted to reciprocate within a cylinder 89 forming part of the horizontal actuator generally designated by reference numeral 90 (FIGS. 1 and 3) which consists of a suitable cylinder piston unit actuated by a suitable fluid pressure medium such as air or oil or combinations thereof. The cylinder 89 of the horizontal actuator 90 is rigidly connected by way of connections 91 and 91' (FIGS. 1 and 3) with a table-like support structure 92 adapted to move up and down on upright columns 93 and 93' (FIG. 1). The table-like support structure 92 itself is carried by a sturdy piston rod 94 (FIGS. 1 and 3) forming part of the vertical actuator generally designated by reference numeral 95 which again consists of a cylinder piston unit including piston rod 94 carrying thereon piston 96 (FIG. 3) which slides within the stationary cylinder 97.

The vacuum system (FIG. 2) generally designated by reference numeral 100 includes a motor 101 driving a vacuum pump 102 which constitute a continuously operating vacuum source. The vacuum pump 102 is connected by way of a vacuum line 103 with a vacuum-adjusting device 104 of conventional construction permitting adjustment of the desired vacuum.

A vacuum line 105 connects the vacuum-adjusting device with an upper overflow unit 106. A vacuum gauge 107, which may also form part of the adjusting device 104, and a vacuum relief valve 108 are also connected with the vacuum line 105. The upper overflow unit includes a dump tube 111 connected with the vacuum line 110 which at the other end is connected with a vacuum manifold 112. The vacuum-connecting nipple 182 (FIG. 4) of a respective nozzle 83 is connected with the vacuum manifold 112 by way of a vacuum line 113 (FIG. 2) while its product-connecting nipple 181 is connected with a supply tank 115 by way of the feed line 114. A discharge connection or dump tube 116 extends from the bottom of the upper overflow unit 106 into the lower overflow unit 118 and is provided at its lower free end with a vacuum-operated pivotal lid or flipper 117. A discharge connection or dump tube 119 permits the discharge of the excess product from the lower overflow unit 118 into an excess product tank 121, whereby the lower free end of the discharge tube 119 is again provided with a vacuum operated pivotal lid or flipper 120.

The inside of the lower overflow unit 118 is additionally connected wwith a line section 123 which leads to a normally open valve 127 connected with a normally closed valve 126 of a valve control unit generally designated by reference numeral 125. The positions of the normally closed valve 126 and of the normally open valve 127 are periodically reversed in predetermined timed relationship by a suitable valve control timer 128 which may include a flip-flop circuit of any known type so as to temporarily open valve 126 and establish a connection with the atmosphere by closing the valve 127 to thereby interrupt the connection of the line section 123 with the vacuum line section 103' while connecting the line section 123 and therewith the inside of the lower overflow unit 118 with atmosphere for purposes of periodically dumping the excess product accumulated in the lower overflow unit 118 into the excess product tank 121 as will be explained more fully hereinafter.

Figure 3:
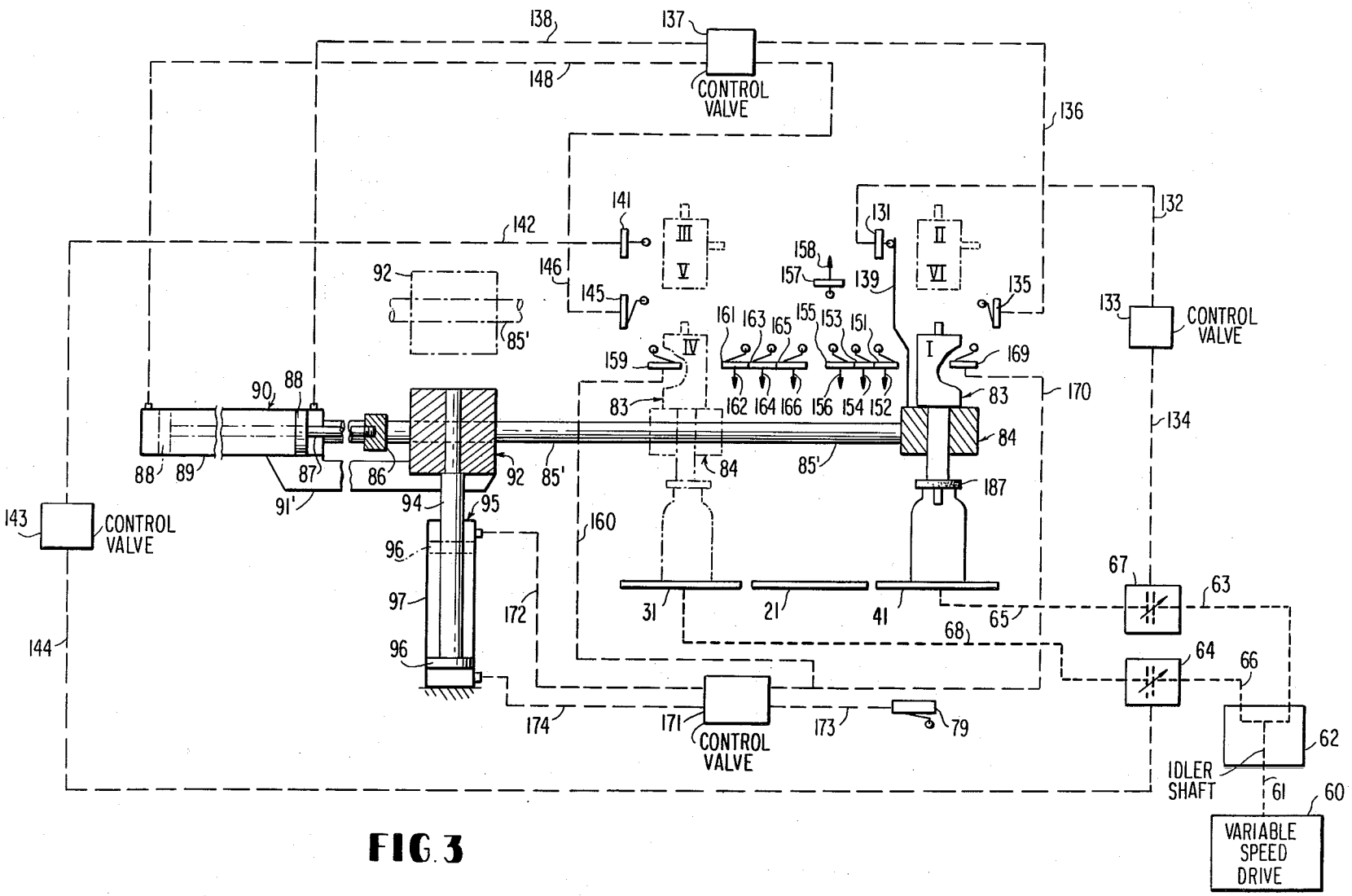
FIG. 3 is a schematic control diagram illustrating the control system of the filling machine in accordance with the present invention.

FIG. 3 schematically illustrates the various controls for automatically operating the filling machine of the present invention through one or more operating cycles. The position of the nozzle structure 83 as it goes through one cycle of operation is shown in full line and designated by reference numeral I, as it is in the filling position in sealing engagement with containers on the outboard conveyor 41; its succesive positions shown in dash-and-dotted lines and designated by reference numerals II, III, IV, V and VI represent the respective positions thereof as it ascends into the fully raised position II, as it reciprocates from the outboard conveyor 41 to the position III over inboard conveyor 31, as it descends from the raised position III to its filling position IV, as it ascends again to its fully raised position V over the outboard conveyor 41, and as it then reciprocates from the inboard conveyor 31 to its position over the outboard conveyor 41, only to redescend thereafter into the filling position I. The control system includes a roller limit switch 131 which is actuated, as schematically indicated, by part 139 when the nozzle support structure 85 together with the nozzles 83 descends from the uppermost position VI into the lowermost filling position I and remains engaged until the nozzle support structure 85 again moves into its uppermost position II. The roller limit switch 131 is operatively connected with a control valve 133 by way of a connection 132 while the control valve 133 is connected with clutch 67 by way of a fluid connection utilizing oil or air under presssure. While connection 132 could be, for example, an electrical connection, a pneumatic connection is preferred in those applications which require an explosion-proof construction, e.g., in applications involving nail polish. In that case, all electric motors are also explosion-proof electric motors.

A one-way roller limit switch 135, actuated near the end of the upward reciprocating motion of the nozzle support structure 85, is connected by way of a pneumatic connection 136 with the control valve 137 which, in turn, is connected by way of a fluid connection 138 with the right end of the horizontal actuator unit generally designated by reference numeral 90 so that feed of a fluid medium under pressure through line 138, as initiated by actuation of the one-way limit switch 135, will start the nozzle structure 85 to reciprocate toward the left as viewed in FIG. 3. A roller limit switch 141, which is actuated when the nozzle structure 85 descends from position III into its lowered filling position IV over the inboard conveyor 31 and remains so actuated by the part 139 until the nozzle support structure 85 reaches again its uppermost position V, is connected by way of a pneumatic connection 142 with a control valve 143 which in turn is connected by way of a fluid connection 144 with the clutch 64. One-way roller limit switch 145 which is actuated near the end of the upward reciprocating motion of the nozzle support structure 85 from its filling position IV in lane 30, is connected by way of a pneumatic connection 146 with the control valve 137 which in turn includes a second fluid connection 148 with the left end of the horizontal actuator 90 to start reciprocating movement toward the right as the nozzle support structure 85 reaches the end of its upward motion from the filling position IV over conveyor 31.

A number of one-way roller limit switches 151, 153 and 155 are actuated as the nozzle support structure 85 reciprocates from position II toward the left in its horizontal movement toward position III. The one-way limit switch 151 is thereby connected by way of the pneumatic connection 152 with the release mechanism (not shown) for the star wheel 44 while the one-way limit switch 153 is connected by way of the pneumatic connection 154 with the release mechanism (not shown) for the star wheel 42 and the one-way limit switch 155 is connected by way of the pneumatic connection 156 with the diverter arm actuating mechanism 27, possibly by the interposition of a control valve in the actuating mechanism 27 which is of the fluid-actuated type. A roller plunger limit switch 157 which is actuated during movement of the nozzle support structure 85 in both directions and thus also during the horizontal reciprocating motion from position II toward the left in the direction toward position III, is connected by way of pneumatic connection 158 with the release mechanism (not shown) for the center lane star wheel 22. A one-way roller limit switch 159 which is actuated by the nozzle support structure 85 near the end of its horizontal reciprocating movement toward the left, is connected by way of the pneumatic connection 160 with the control valve 171 which by way of the fluid connection 172 is connected with the upper end of the cylinder 97 of the vertical actuator 95.

During the reciprocating motion of the nozzle support structure 85 toward the right from position V toward position VI thereof, one-way roller limit switches 161, 163 and 165 are actuated which are connected by way of pneumatic connections 162, 164 and 166, respectively, with the release mechanism (not shown) for the star wheel 34, with the release mechanism (not shown) for the star wheel 32 and with the diverter arm actuating mechanism 27. The one-way limit switch 169 is actuated near the end of the reciprocating movement toward the right of the nozzle support structure 85 which in turn is connected by way of the pneumatic connection 170 with the control valve 171 to initiate the downward movement of the nozzle support structure together with the table-like support structure 92 by means of the vertical actuator 95. The nozzle inserter limit switch 79 (FIGS. 1 and 3) is also connected by way of the pneumatic connection 173 with the control valve 171 so that upon actuation of the nozzle inserter limit switch 79 by cam portion 75' (FIG. 1) during rotation of cam shaft 73, the control valve 171 will feed fluid under pressure to the bottom of the vertical actuator 95 to start the ascending motion of the table-like support structure 92 together with the nozzle support structure 85.

As can be seen from FIG. 4, a seal 187 mounted over the outer tubular member 184 at the bottom of the nozzle structure 180 is adapted to seal off the top of a container when the nozzle structure is lowered into engagement with the top. The amount filled into the container is determined by the distance d (FIG. 4) by which the inner and outer nozzle members 184 and 186 extend into the container.

OPERATION

Assuming that the machine is in the position I shown in FIG 3, in which the nozzle support structure 85 is in its lower position over the outboard filling channel 40, i.e., with the nozzle structures 83 thereof in the filling position, in which seals 187 thereof hermetically seal the top of the containers. If the on-off switch 176 is now turned to the "on" position and with the "no-bottle/no-fill" switch 177 reflecting the presence of containers, the control valve 77 is actuated whereupon clutch 72 is engaged so that cam shaft 73 begins to rotate. As the cam portion 75' on cam 75 actuates the nozzle inserter limit switch 79 (FIGS. 1 and 3), it will actuate the control valve 171 by way of the connection 173, which will cause fluid pressure to be applied to the bottom of the vertical actuator 95, causing the nozzle support structure 85 to rise toward position II.

As the nozzle support structure 85 reaches its uppermost position II, roller limit switch 131 falls off the actuator cam part 139 causing the outboard conveyor 41 to start running by engagement of clutch 67 via actuating control valve 133. The one-way roller limit switch 135 is also actuated by the upward motion of the nozzle support structure 85 which will actuate control valve 137 and thereby apply fluid pressure to the right hand end of the horizontal actuator 90. The nozzle support structure will now start to reciprocate from position II toward the left in FIG. 3, i.e., toward the position III over the inboard conveyor 31.

As the nozzle support structure 85 travels toward the left in FIG. 3, the one-way roller limit switch 151 is actuated, thereby releasing the outboard star wheel 44. Actuation of the one-way roller limit switch 153 will in turn release the outboard star wheel 42, thereby allowing containers to leave the filling area and another set of containers to move into the filling area. Actuation of one-way roller limit switch 155 will cause the diverter arm 26 to divert the incoming containers onto the outboard conveyor 41. When roller plunger limit switch 157 is actuated, the star wheel 22 of the center lane is released, thereby allowing a set of containers to travel to the filling area of the outboard filling channel 40. Upon reaching the maximum reciprocating motion toward the inboard lane or channel at position III, the one-way roller limit switch 159 is actuated which will actuate control valve 177 to supply a fluid medium to the vertical actuator 95 to thereby cause the nozzle support structure 85 to descend over containers already in their position in the filling area of the inboard conveyor 31 into position IV. As the nozzle support structure descends from position III into position IV, the roller limit switch 141 is actuated which stops the movement of the inboard conveyor 31 by way of control valve 143.

With all of the filling nozzles 83 in the filling position, in which the seals 187 thereof seal off the top of the containers, the filling operation will now commence, as will be described more fully hereinafter by reference to FIG. 2. The filling operation is stopped when the cam 75 on cam shaft 73 (FIG. 1) again actuates with its cam portion 75' the nozzle inserter limit switch 79 which, by way of its connection 173, actuates control valve 171 and causes the nozzle support structure 85 to ascend from position IV toward position V. As the nozzle support structure 85 reaches its uppermost position V, roller limit switch 141 will fall off the actuator cam part 139 causing the inboard conveyor 31, to operate again by engaging clutch 64. One-way roller limit switch 145 is also actuated by the upward motion of the nozzle support structure 85, which, by way of its connection with the control valve 137 and by way of the fluid connection 148, will cause the nozzle support structure 85 to start its reciprocation movement from position V toward the right in a direction toward position VI over the outboard lane 40. As the nozzle support structure 85 travels toward the outboard conveyor 41, one-way roller limit switches 161, 163 and 165 are actuated which cause release of the inboard star wheel 34 and of the inboard star wheel 32 and of the deflection mechanism 27 for the diverter arm 26 to divert the incoming containers onto the inboard conveyor 31. As the roller-plunger limit switch 157 is actuated, the star wheel 22 of the center lane will again be released, allowing one set of containers to travel to the inboard filling area.

Upon reaching maximum reciprocating motion toward the right in position VI, the nozzle support structure 85 will actuate one-way roller limit switch 169 which, by way of its connection with the control valve 171 and fluid connection 172, will operate the vertical actuator 95 to cause the nozzle support structure 85 to descend into its filling position I. As the nozzle support structure descends, the roller limit switch 131 is again actuated, thereby stopping the outboard conveyor 41 by disengagement of clutch 67. The machine will continue to operate until the on-off switch 176 (FIG. 1) is turned to the "off" position at which time the cam portion 75' of cam 75 will causse the machine to stop with the nozzles immersed in just-filled containers which remain hermetically sealed, when actuation of the nozzle inserter limit switch 76 stops the nozzle support structure in a fully lowered position. The single-cycle limit switch 76 limits operation of the machine 40 to a single filling cycle.

The operation of the vacuum system shown in FIG. 2 is as follows: When the nozzle support structure 85 descends, the nozzles 83 enter the containers and the elastic washers 187 seal the top of the containers. The vacuum pump sucks all of the air out of the containers by way of the inner tubular member 186, the vacuum line section 113, the vacuum manifold 112, the vacuum line section 110, the upper overflow unit 106, the vacuum line section 105 and the vacuum line section 103. The existence of the vacuum in the upper overflow unit 106 also causes the pivotal lid 117 to be pulled tight against the dump tube 116 in the lower overflow unit 118. Product is then pulled from the supply tank 115 through the supply line 114, the inlet nipples 181 and the space between lines 186 ad 184 of vacuum nozzles 83 into the containers. Excess material in the containers is pulled through the vacuum line sections 113 and 110 into the upper overflow unit 106.

The flip-flop control 128, with valve 126 closed and valve 127 open, will cause vacuum to be established also in the lower overflow unit 118, causing the pivotal lid 120 to be pulled tight against the free end of the lower overflow dump tube 119. When this is the case, i.e., when vacuum exists in both the upper and lower overflow units 106 and 118, the lid 117 in the lower overflow unit will open, thereby permitting product to flow from the upper overflow unit into the lower overflow unit. When the valve control 128 opens the valve 126 thereby disconnecting the line 123 from the vacuum source and connecting the same by way of now-closed valve 127 with the atmosphere, atmospheric pressure will establish itself inside the lower overflow unit 118, thereby causing the lid 117 to be pulled tight against the dump tube 116. On the other hand, since atmospheric pressure now prevails within the lower overflow unit 118, the lid 120 will now open, thereby permitting the overflow product to drop into the excess product tank 121.

During normal operation, when the nozzles 83 are lifted off the containers, the vacuum is broken and the product will not flow until the nozzles enter again another set of containers. To avoid air contact for quick-drying products when the machine is stopped, the nozzles 83 will remain in the sealed containers as described above to prevent drying of the product on the nozzle structures or possibly in other parts of the system. This greatly simplifies the set-up as well as the change, for example, of any color nail polish as the product to be filled. Moreover, the nozzles 83 are in communication with the atmosphere only during the transfer of the nozzle support structure from one lane to the other which is relatively short. However, to reduce the danger of dry-up in the system, according to another feature of the present invention, the vacuum system of FIG. 2 may include a control valve 189 connected ahead of the vacuum-adjusting device 104 which is normally open during the filling operation when the nozzles are in positions I and IV. In parallel with the control valve 189 and vacuum-adjusting device 104 is another control valve 191 and vacuum-adjusting device 190, whereby the control valve 189 is closed and the control valve 191 is opened during the transfer portion of the operating cycle. If a vacuum of, for example, 23" Hg is adjusted by means of the adjusting device 104 and a vacuum of, for example, 5" Hg is adjusted by means of the adjusting device 190, then relatively little air is sucked in during the transfer portion of the operating cycle due to the reduction in the absolute vacuum in the system. This further enhances the safety against unintended dry-up of the product on parts of the system, in particular on parts of the nozzles. The control valves 189 and 191 may thereby be actuated again by conventional limit switches, as described hereinabove. Since the components of the pneumatic and pneumatic/hydraulic system are commercially available and known as such, a detailed description thereof is dispensed with herein. Moreover, the various limit switches are shown only schematically in FIG. 3, their actual position being appropriately selected to suit the operation of the machine.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A filling machine with a filling station for filling containers with a fluid product by the use of filling nozzle means, which comprises two substantially parallel filling channel means within the area of the filling stations which are defined at least in part by conveyor means, filling means operatively connected with the filling nozzle means, nozzle support means supporting thereon the filling nozzle means in proper position, means for lowering and raising the nozzle support means and therewith the filling nozzle means into and out of containers held stationary under the filling nozzle means, indexing means for determining the correct number of containers to be filled at the same time in a respective filling channel means during a given filling operation while held stationary in their filling position, reciprocating means for the nozzle support means to alternately place the filling nozzle means over the containers to be filled in one filling channel means and after completion of the filling operation to move the nozzle support means generally transversely to the direction of movement of the conveyor means over filling channel means to fill the containers which have been brought into filling position in the meantime in said other filling channel means and which are held stationary thereat during the filling operation, and means for operating the filling machine through at least one control cycle including control means for the indexing means, the reciprocating means, the means for lowering and raising the nozzle support means and the filling means, characterized in that each channel means includes a separate conveyor means, said control means including further means for individually controlling each separate conveyor means for individually controlled intermittent operation thereof to enable stoppage of a respective separate conveyor means while containers conveyed thereby are being filled.

2. A filling machine according to claim 1, characterized in that each separate conveyor means is operable to be individually started and stopped by its selectively engageable and disengageable drive means to bring a number of containers into their proper position by movement of the respective conveyor means and to remain stationary while the corresponding containers are filled with the product during a given filling operation.

3. A filling machine according to claim 2, characterized in that the two filling channel means merge into a feed-out channel means downstream of the filling station, said feed-out channel means being defined at least in part by a further conveyor means.

4. A filling machine according to claim 3, characterized in that the feed-out channel means is located between said two substantially parallel filling channel means.

5. A filling machine according to claim 1, 2, 3 or 4, characterized in that the linear speed of the further conveyor means of the feed-out channel means is greater than the linear speed of the separate conveyor means of the two filling channel means.

6. A filling machine according to claim 5, characterized in that the further conveyor means of the feed-out channel means runs continuously during operation of the machine.

7. A filling machine according to claim 6, characterized in that a feed-in channel means branches out into the two filling channel means upstream of the filling station, said feed-in channel means being defined at least in part by said further conveyor means.

8. A filling machine according to claim 7, characterized in that a diverter means is provided within the area where the feed-in channel means branches into the two filling channel means to selectively divert the containers from said feed-in channel means into one or the other of the two substantially parallel filling channel means.

9. A filling machine according to claim 8, characterized in that said diverter means is selectively actuated during reciproating movement by control means provided therefor into the position thereof in which it directs containers into the filling channel means in which containers were filled during the immediately preceding filling operation.

10. A filling machine according to claim 9, characterized in that the filling machine includes control means for stopping the filling machine in such a position that the filling nozzle means remain in containers just filled with product.

11. A filling machine with drive means for an actuating shaft forming part of said last-mentioned control means according to claim 10, characterized in that said control means includes a switch means on a shaft rotating in unison with the drive means for initiating the control cycle of the filling machine.

12. A filling machine according to claim 11, characterized by single cycle control means operatively associated with said shaft.

13. A filling machine according to claim 11, characterized in that at least the lowering as also the reciprocating movements of the nozzle support means are controlled by limit switch means responsive to physical movement of a respective part near the end of its movement in a given direction.

14. A filling machine according to claim 1, characterized in that the two channel means merge into a feed-out channel means downstream of the filling station, said feed-out channel means being defined at least in part by a further conveyor means.

15. A filling machine according to claim 14, characterized in that the feed-out channel means is located between said two substantially parallel channel means.

16. A filling machine according to claim 14, characterized in that a feed-in channel means branches out into the two channel means upstream of the filling station, said feed-in channel means being defined at least in part by said further conveyor means.

17. A filling machine according to claim 16, characterized in that a diverter means is provided within the area where the feed-in channel means branches into the two channel means to selectively divert the containers from said feed-in channel means into one or the other of the two substantially parallel channel means.

18. A filling machine according to claim 17, characterized in that said diverter means is selectively actuated during reciprocating movement by control means provided therefor into the position thereof in which it directs containers into the filling channel means in which containers were filled during the immediately preceding filling operation.

19. A filling machine according to claim 1, characterized in that the filling machine includes control means for stopping the filling machine in such a position that the filling nozzle means remain in containers just filled with product.

20. A filling machine with drive means for an actuating shaft forming part of said last-mentioned control means according to claim 19, characterized in that said control means includes a switch means on a shaft rotating in unison with the drive means for initiating the control cycle of the filling machine.

21. A filling machine according to claim 20, characterized by single cycle control means operatively associated with said shaft.

22. A filling machine according to claim 19, characterized in that at least the lowering as also the reciprocating movements of the nozzle support means are controlled by limit switch means responsive to physical movement of a respective part near the end of its movement in a given direction.

23. A filling machine according to claim 1, characterized in that control means for intermittently operating the separate conveyor means of the two channel means are operable in such a manner that a respective separate conveyor means is stopped while the containers thereon are being filled at the filling station during a given filling operation and is started again after completion of the filling operation to run thereafter continuously until a predetermined period of time before the next filling operation begins in the same channel means.

24. A filling machine according to claim 23, characterized in that the filling machine is a straight-line vacuum filling machine with a vacuum system in which the nozzle means include seal means operable to seal off the containers, when the nozzle means have been lowered into the filling position, first means for connecting the nozzle means with a supply of product to be filled, and second means for connecting the nozzle means with a vacuum source of the vacuum system so that each container is filled to a predetermined height corresponding essentially to the extent of insertion of the tip of the nozzle means into the containers, the product being sucked into the containers through the first means by vacuum established therein by way of said second means.

25. A filling machine according to claim 24, characterized in that each nozzle means includes a first tubular part of larger cross-sectional area for connection with said first means and a second tubular part of smaller cross-sectional area and disposed over at least part of its length in said first tubular part, said second tubular part adapted to be connected with said second means, said first and second tubular parts terminating at least approximately in a common transverse plane.

26. A filling machine according to claim 25, characterized in that said second tubular part is of approximately oval cross section with one wall thereof rigidly secured to a portion of the inside wall of the first tubular part.

27. A filling machine according to claim 26, characterized in that the vacuum system includes an upper overflow unit operatively connected by a first portion of said first means with the nozzle means and by a second portion thereof with said vacuum source, a lower overflow unit connected with said upper overflow unit by way of a discharge tube extending from said upper to said lower overflow unit and having a vacuum-operated flipper lid at its discharge end, a discharge tube connected with the lower overflow unit and having a vacuum-operated flipper lid at its discharge end, and third means including valve means and valve timer means for selectively connecting the inside of said lower overflow unit with the vacuum source and with atmospheric air in predetermined timed relationship.

28. A filling machine according to claim 27, characterized by means for changing the vacuum in said first means in such a manner that at least during a substantial portion of each reciprocating movement of said nozzle support means, the vacuum in said first means is substantially reduced to lessen the aspiration of air through the nozzle means while in transfer from one channel means to the other and vice versa.

29. A filling machine according to claim 24, characterized in that the vacuum system includes an upper overflow unit operatively connected by a first portion of said first means with the nozzle means and by a second portion thereof with said vacuum source, a lower overflow unit connected with said upper overflow unit by way of a discharge tube extending from said upper to said lower overflow unit and having a vacuum-operated flipper lid at its discharge end, a discharge tube connected with the lower overflow unit and having a vacuum-operated flipper lid at its discharge end, and third means including valve means and valve timer means for selectively connecting the inside of said lower overflow unit with atmospheric air and with the vacuum source in predetermined time relationship.

30. A filling machine according to claim 1, characterized in that at least some of said control means are sequence control means operable by movement respectively by near completion of movement of the nozzle support means.

31. A filling machine according to claim 23, 24, 29 or 30, characterized in that the filling machine includes control means for stopping the filling machine in such a position that the filling nozzle means remain in containers just filled with product.

32. A filling machine with drive means for an actuating shaft forming part of said last-mentioned control means according to claim 31, characterized in that said control means includes a switch means on a shaft rotating in unison with the drive means for initiating the control cycle of the filling machine.

33. A filling machine according to claim 32, characterized by single-cycle control means operatively associated with said shaft.

34. A filling machine according to claim 31, characterized in that at least the lowering as also the reciprocating movements of the nozzle support means are controlled by limit switch means responsive to physical movement of a respective part near the end of its movement in a given direction.

35. A straight-line vacuum filling machine with a filling station for filling open containers with a fluid product by the use of filling nozzle means, which comprises two substantially parallel filling channel means within the area of the filling stations which are defined at least in part by conveyor means, vacuum-operated filling means operatively connected with the filling nozzle means, each filling nozzle means having sealing means for sealing off the open containers in their respective filling positions, nozzle support means supporting thereon the filling nozzle means in proper position, means for lowering and raising the nozzle support means and therewith the filling nozzle means into and out of containers held stationary under the filling nozzle means, indexing means for determining the correct number of containers to be filled at the same time in a respective channel means during a given filling operation while held stationary in their filling positions, reciprocating means for the nozzle support means to alternately place the filling nozzle means over the containers to be filled in one filling channel means and after completion of the filling operation to move the nozzle support means generally transversely to the direction of movement of the conveyor means over the other filling channel means to fill the containers which have been brought into filling position in the meantime in said other filling channel means and which are held stationary thereat during the filling operation, and means for operating the filling machine through at least one control cycle including control means for the indexing means, the reciprocating means, the means for lowering and raising the nozzle support means and the filling means, each channel means including a separate conveyor means, said control means including further means for individually controlling each separate conveyor means for individually controlled intermittent operation thereof to enable stoppage of a respective separate conveyor means while containers conveyed thereby are being filled so as to minimize the danger of breaking the vacuum seal established by said sealing means during the filling operation.

36. A filling machine according to claim 35, in which said further means includes selectively engageable and disengageable drive means for each separate conveyor means to individually start and stop each separate conveyor means in such a manner that a predetermined number of containers is brought into their proper position by movement of a respective separate conveyor means which are held stationary by stoppage of the same separate conveyor means when being filled with the product during a respective filling operation.

37. A filling machine according to claim 36, in which said control means includes stopping means for stopping the filling machine in such a position that the filling nozzles remain in containers just filled with the product in such a manner that the open containers remain sealed off by said sealing means.

38. A filling machine according to claim 36, wherein said vacuum-operated filling means includes first means for connecting the nozzle means with a supply of product to be filled, and second means for connecting the nozzle means with a vacuum source so that each container is filled to a predetermined height corresponding essentially to the extent of insertion of the tip of the nozzle means into the containers, the product being sucked into the containers through the first means by vacuum established therein by way of said second means.

39. A filling machine according to any one of claims 35, 36, 37 or 38, in which the two filling channel means merge into a feed-out channel means downstream of the filling station, said feed-out channel means being defined at least in part by a further conveyor means located between said two substantially parallel filling channel means.

40. A filling machine according to claim 39, in that the linear speed of the further conveyor means of the feed-out channel means is greater than the linear speed of the separate conveyor means of the two filling channel means.

41. A filling machine according to claim 39, characterized in that the further conveyor means of the feed-out channel means runs continuously during cyclic operation of the machine.

42. A filling machine according to claim 39, characterized in that said further conveyor means also defines in part a feed-in channel means which branches into the two filling channel means downstream of the filling station.

* * * * *